US005875858A

United States Patent [19]

Brady

[11] Patent Number: 5,875,858

[45] Date of Patent: Mar. 2, 1999

[54] LOW VOLUME AIR-WATER DRILLING SYSTEMS AND METHODS

[76] Inventor: William J. Brady, 1767 Wishingwell Dr., Creve Coeur, Mo. 63141

[21] Appl. No.: 689,667

[22] Filed: Aug. 13, 1996

Related U.S. Application Data

[63] Continuation-in-part of Ser. No. 472,913, Jun. 7, 1995, abandoned.

[51] Int. Cl.[6] ..... E21C 27/32

[52] U.S. Cl. ..... 175/68; 175/69; 175/71; 299/34.05

[58] Field of Search ..... 175/63, 68, 69, 175/71; 299/7, 16, 17, 34.03–34.05, 95

[56] References Cited

U.S. PATENT DOCUMENTS 3,130,798 4/1964 Schramm et al. ..... 175/71 X
4,474,252 10/1984 Thompson ..... 175/69

*Primary Examiner*—Roger J. Schoeppel
*Attorney, Agent, or Firm*—Richard G. Heywood

[57] ABSTRACT

An air-water mist flushing system and method for cooling and cleansing mining tool cutter elements having sources of water and compressed air, apparatus for admixing water and compressed air at predetermined volumes and pressures to form the air-water mist, and apparatus for delivering the air-water mist to the drill bit situs.

27 Claims, 2 Drawing Sheets

LOW VOLUME AIR-WATER DRILLING SYSTEMS AND METHODS

This application is a continuation-in-part of patent application Ser. No. 08/472,913 filed Jun. 7, 1995, now abandoned.

BACKGROUND OF THE INVENTION

1. Field of the Invention

The invention relates generally to rotary drag bits, and more specifically to improvements in roof drill bit systems and methods for drilling and boring as in roof bolting operations for tunnel construction and mining.

2. Description of the Prior Art

In the fields of industrial, mining and construction tools, polycrystalline diamond (PCD) is becoming more widely used in making cutting tool inserts, sometimes called polycrystalline diamond compacts (PDC). PCD materials are formed of fine diamond powder sintered by intercrystalline bonding under high temperature/high pressure diamond synthesis technology into a predetermined layer or shape; and such PCD layers are usually permanently bonded to a substrate of "precemented" tungsten carbide to form such PDC insert or compact. The term "high density ceramic" (HDC) is sometimes used to refer to a mining tool having an insert with a PCD layer. The term "chemical vapor deposition" (CVD) is a form of pure PCD used for inserts that are denser and last longer in use in the mining field. Other hard surfacing and layering materials, such as layered "nitride" compositions of titanium (TiN) and carbon ($C_2N_2$), are gaining acceptance in the mining field. All such "hard surface" materials—PCD, CVD and nitride compositions as well as titanium carbide and other more conventional bit materials are applicable to the present invention and considered alternatives unless specifically distinguished from each other herein.

Some of the basic underlying technology pertaining to PCD materials is disclosed in U. S. Pat. Nos. 4,525,178; 4,570,726; 4,604,106; and 4,694,918. In particular, U.S. Pat. No. 4,570,726 discloses special insert shapes for coring-type rotary drill bits, and suggests a tool having a curved working surface positioned at a slight negative rake angle from the axis of rotation (see also U.S. Pat. No. 4,858,707). The use of PCD materials in rotary earth drilling equipment replaces the long time use of tungsten carbide or the like as an abrasive cutting material; and most developmental work in PCD/CVD rotary drilling has been in the oil/gas field involving deep well boring into the earth's crust.

The principal types of drill bits used in rotary drilling operations are roller bits and drag bits. In roller bits, rolled cones are secured in sequences on the bit to form cutting teeth to crush and break up rock and earth material by compressive force as the bit is rotated at the bottom of the bore hole. In drag bits, PCD cutting elements on the bit act to cut or shear the earth material. The action of some flushing medium, such as fluid drilling mud or compressed air, is important in all types of drilling operations to cool the cutting elements and to flush or transport cuttings away from the cutting elements and to the upper surface of the well. It is important to remove cuttings to prevent accumulations that may plug water passages and "ball up" or otherwise interfere with the crushing or cutting action of the bit, and the cooling action is particularly important in the use of PCD/CVD cutters to prevent carbon transformation of the diamond material. In deep well drilling the circulation of drilling mud is contained in the well bore hole and can be recaptured and recirculated to the well surface. U. S. Pat. No. 5,358,063 discloses a deep well drill bit having a series of hard material button inserts, and the invention pertains to improvements in transporting the flushing medium (compressed air) to prevent erosion around and loosening of the inserts.

Although roof drill bits are a form of rotary drag bit, it will be recognized that there are vast differences from deep well drilling. Roof bolting operations are overhead so the drilling operation is upward rather than downward, and in most cases the earth structure is formed of extremely hard rock or mineral (coal) deposits, although stratas of shale, loose (fractured) rock and mud layers are frequently encountered in boring (drilling) operations for roof bolting construction. The use of large quantities of water (drilling mud) is typical in roof drilling to cool the cutting elements and flush the cuttings away, but overhead irrigation results in uncontrolled water loss and floor flooding that make working conditions unsafe and unpleasant. It should be recognized that the presence of methane gas in coal mines and the like also constituted a safety hazard, and respirable dust is a further safety consideration in the mining industry. My prior U.S. Pat. Nos. 5,180,022; 5,303,787 and 5,383,526 disclose substantial improvements in HCD roof drill bits using PCD cutting elements constructed in a non-coring arrangement, and also teach novel drilling methods that greatly accelerate the speed of drilling action and substantially reduce bit breakage and change-over downtime. However, in earth structures that include shale, mud seams and other broken and soft formations, the HCD non-coring drill bit of my prior invention easily drills through but tends to plug and the cutting inserts may even shatter in working through stratas of extremely hard, fractured and muddy earth conditions.

In a typical roof bolting operation, a series of 4 foot to 6 foot holes having a diameter of ¾ inch to 2 inches (or more) are drilled in the tunnel roof to receive bolts for anchoring roof support structures. In the past using tungsten carbide bits, frequently only a single 4 foot hole might be drilled before the bit became dull or broken. My prior invention of non-coring PCD insert drill bits (as disclosed in my prior '022 and '787 patents) was capable of drilling over 100–300 holes of 4 foot depth with a single bit and in shorter times with less thrust than the standard carbide bits in hard rock formations of 22,000–28,000 psi. However, as noted, it has been discovered that this prior non-coring drill bit tends to plug in drilling through mud seams and other soft or broken earth formations. It should be noted also that where long flexible cable roof bolts are used as for some soft earth formations, 12 foot to 24 foot holes are required and it may take up to 30 minutes to drill a single hole using prior art drill bits.

SUMMARY OF THE INVENTION

The present invention is embodied in a system and method for drilling bores in mineral, rock and soft earth formations using a rotary drill bit with hard surface cutter means constructed and arranged for optimum operation within preselected axial thrust and rotational speed parameters, which system and method includes means for delivering and admixing a low volume of water and a stream of compressed air to form an air mist flushing fluid, and means for delivering a constant low volume of the air mist flushing fluid to the cutter means.

Comparative tests conducted in three states have determined that the amount of water required to wet drill with PCD rotary bits may be reduced from a range of 9–18 gallons per minute down to about 1–3 quarts per minute when atomized into an air mist that effectively scours and cools the PCD inserts. Wet drilling in non-recoverable drilling operations currently being used achieves a penetration of 6–9 ft./min. requiring 6–9 gal./min. at 90 psi or 9–14 gal./min. at 150 psi or 18 gal./min. at 300; psi. Experimental testing in West Virginia was in fairly solid, 65% quartz sandstone with some 4 inch mud seams using HDC rotary bits and air-water jet mist; the result achieved a penetration rate of 12 ft./min. with no plugging as compared with usual 6–9 ft./min. penetration using only water as the flushing agent. In Utah, experimental testing was conducted in a very muddy sandstone top with 20% silica content using HDC 1⅓₂ inch roof drill bits and 100–120 psi air-water mist. Prior conventional drilling of each 6 foot hole in this mine with water only was timed at 4–6 minutes, as compared to 45–70 seconds by using the air-water mist of the present invention. The U. S. Bureau of Mines learned of my previous experimental testing in U. S. and Canadian mines, and ordered an independent test relative to respirable dust generated in drilling quartz sandstone; it was determined that a substantial reduction in respirable dust results from using the air-water jet mist over the use of air per se.

In comparing the air-water jet mist to prior art "water only" flushing, it should be emphasized that the present invention utilizes only about 3 qts./min./drill column as compared to 6–9 gals./min. resulting in water savings into the millions of gallons range per mine each year.

It is an object of the present invention to provide a low volume air-water drilling system and method that greatly reduces the amount of water required for effective hole flushing, that substantially reduces the amount of respirable dust in mining operations, that is able to accommodate drilling in all roof conditions, i.e. sandstone, limestone, shale, fractured rock and muddy seams, that can be used safely and effectively in methane environments, and that improves the quality of coal and working environment in coal mining. These and other objects and advantages will become more apparent hereinafter.

BRIEF DESCRIPTION OF THE DRAWINGS

In the accompanying drawings which form a part of this specification and wherein like numerals refer to like parts wherever they occur.

BRIEF DESCRIPTION OF THE PREFERRED EMBODIMENTS

This application is a continuation-in-part of my application Ser. No. 08/472,913, which is related by common subject matter to a co-filed application entitled Roof Drill Bit With Radial Domed PCD Inserts, now U.S. Pat. No. 5,535,839.

The present invention pertains generally to mining operations that include roof drilling, longwall mining and continuous mining in which water flushing is non-recoverable; and specifically the invention pertains to improvements in systems and methods for delivering low volumes of non-recoverable flushing fluids effective for cooling and cleaning the drill bit cutting elements.

Figure 1:
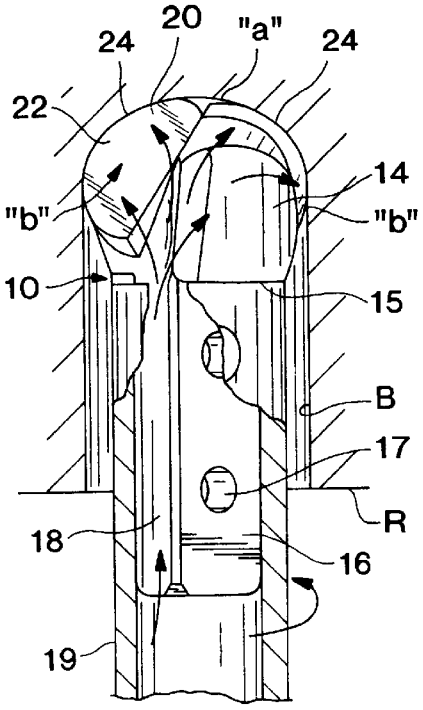
FIG. 1 is a side elevational view, partly broken away, showing one form of rotary drill bit applicable to the present invention.
Figure 2:
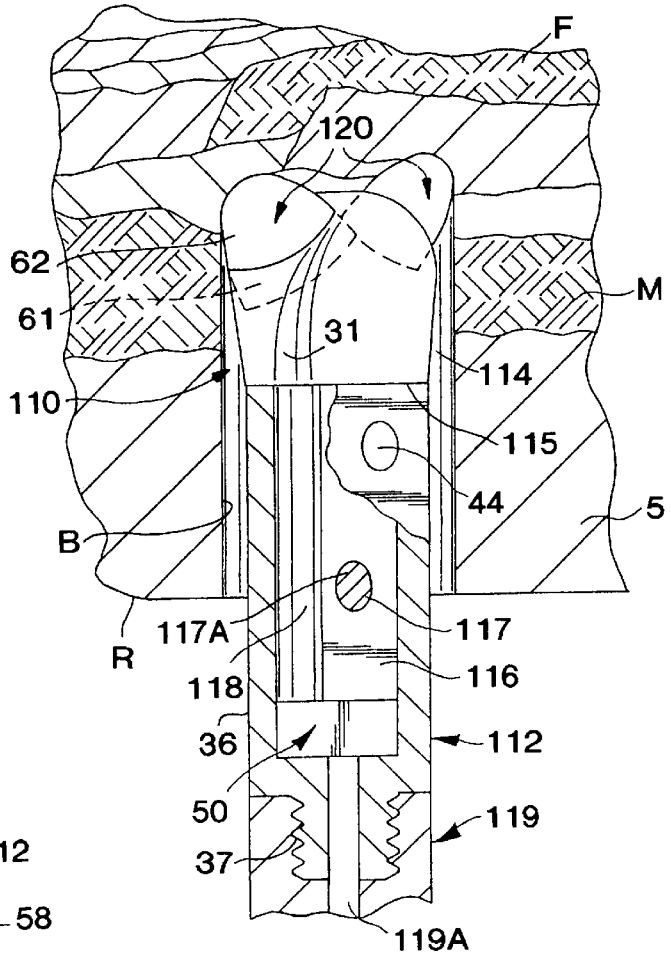
FIG. 2 is another side elevational view, partly broken away, illustrating another form of rotary drill bit and a mounting adapter feature of the invention.
Figure 3:
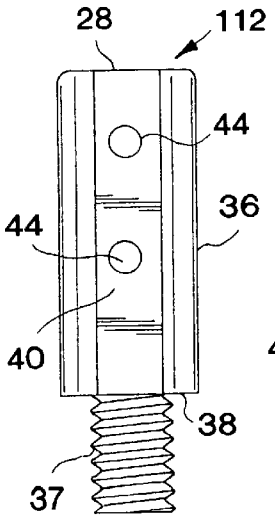
FIG. 3 is a side elevational view of the mounting adapter as rotated 45° from FIG. 2.
Figure 4:
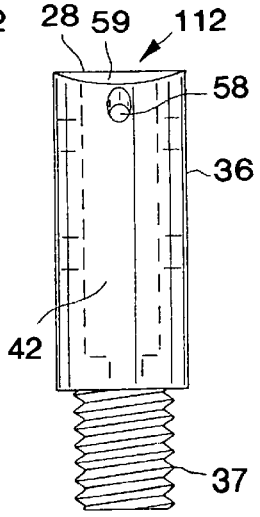
FIG. 4 is a side elevational view of the mounting adapter as rotated 90° from FIG. 3.
Figure 5:
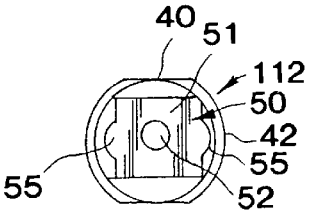
FIG. 5 is a top plan view of the adapter.

FIGS. 1 and 2 are shown for environmental purposes. FIG. 1 shows one embodiment of my earlier non-coring roof drill bit as taught by my U.S. Pat. Nos. 5,180,022; 5,303,787 and 5,383,526—the disclosures of which are incorporated by reference herein as though fully set forth. Briefly stated, this non-coring roof drill bit 10 has a steel head portion 14 and shank portion 16 with bolt holes 17 for attachment at seat 15 to a long rod drive steel 19 of a drilling machine, such as a New Fletcher double boom roof bolter (shown in FIG. 6). The shank 16 has vertical water flutes 18 formed on opposite sides for channeling flushing fluids used for cooling and cleaning the cutter inserts 20 of the drill bit 10. These cutter inserts 20 are formed from a PCD disc cut into two semi-round halves that are applied to oppositely facing surfaces of the head portion 14. The wear faces 22 of the inserts 20 are oppositely facing in the direction of rotation and are positioned at negative rake and skew angles so that the cutting edges 24 perform a slicing action in cutting hard rock formations, and the effective cutting arc is about 120° extending from beyond high entry point "a" past the gauge cutting outer margin to point "b" . The insert 10 is non-coring since the cutting edges of the inserts 20 come substantially together at the axis of the drill bit to define a sinusoidal or S-shaped cutting arc across the diameter of the drill bit tool. This tool is shown drilling bore B in roof top R. This non-coring roof drill bit constitutes a major advance in providing a long wearing drill bit that in all respects out performs any prior carbide bit, and is especially successful in drilling through extremely hard rock formations. However, it has been found that the non-coring drill bit 10 tends to plug in softer earth formations, and my co-filed application provides a coring-type rotary drill that performs extremely well in these soft and broken earth conditions.

Referring to FIGS. 2–5, one embodiment of the coring roof drill bit 110 is shown connected through a mounting adapter 112 to a drive steel 119 and operates to drill a bore B in the roof R as in a mine or tunnel. The roof top formation in this view is lined to illustrate solid rock S, fractured rock or shale F and mud seams M. The drill bit 110 has a steel head mass 114 for seating and supporting hard surfaced cutter inserts 120, and the bit body also includes a mounting shank 116 that is removably secured to the drive steel 119 of the drilling machine (see FIG. 6). It will be understood that the drill bit 110 may be connected directly to the drive steel 119, but that a mounting adapter 112 offers a novel coupling method that forms a feature of the present invention. Thus, the body mass 114 has an annular shoulder 115 adapted to seat against the upper surface 128 of the adapter 112. The shank portion 116 of the drill bit is provided with the usual vertical water flutes 118 recessed inwardly on opposite sides of the shank and which serve to channel the flushing fluid of the present system for cooling the cutter inserts 120 and cleaning away debris from the cutting area of the tool. The shank 116 has cross-bores 117 between opposed flat outer surfaces of the shank to receive fastening pins or bolts 117A.

The mounting adapter 112 of the invention has an elongate body 36 with a threaded stub 37 on its lower end 38 for removable threaded connection to the upper end of a drive steel 119. The outer body wall of the adapter 112 has opposed flat surfaces 40 for wrench engagement and a pair of arcuate surfaces 42 substantially complementary to the drive steel outer wall. Aligned cross bores 44 are formed in flat walls 40 to match the cross bores 117 in the shank 116 of the drill bit 10 and receive the fastening pins 117A therethrough. The mounting adapter 112 permits rapid assembly and disassembly for replacing the drill bit 10 on the drive steel 14 with a minimum of unproductive downtime. Another important function of the mounting adapter 112 is to accommodate the flow of flushing fluid from the hollow drive steel chamber 119A to the head mass 114 and cutter inserts 120. To that end the adapter 12 has a central body chamber 50 that connects through a port 52 in the threaded boss 37 to the drive steel chamber 119A. The central chamber 50 is constructed and arranged to receive the drill bit shank 116 with a sliding fit of the flat opposed shank walls to prevent relative rotation. In this assembled relationship, the head mass shoulder 115 seats on the upper end 28 of the adapter 112 and it should be noted that the lower end of the shank 116 is spaced above the floor 51 of central chamber 50 to define an open fluid receiving cavity for distribution to the opposed shank flutes 118. This distribution—and the vertical flow of flushing fluid upwardly through the adapter 112 is enhanced by providing vertical water flues or canals 55 in the opposed walls 56 openly exposed to the shank water flutes 118. In addition, a pair of jet ports 58 are angularly formed between these water flues 55 and the outer arcuate adapter walls 42 adjacent to the upper end 28, which is beveled, at 59, to better accommodate the upward jetting or flushing fluid along the flumes 31 in the head mass 114 extending from the water flutes 118 and flues 55 to the cutter elements 120.

As shown in FIG. 2, a preferred coring-type drill bit 110 has at least two cutter inserts 120, each having a bullet-shaped carbide body with a cylindrical base 61 and an integral domed head 62 provided with a hard surfacing material such as PCD/CVD or nitride compositions of titanium, carbon and carbon boron. The domed insert head 62 is shaped as a paraboloid with a radially curved or rounded dome end around the axis of the insert 120 which may be referred to herein as a "radially domed insert" or a "paraboloid" insert.

The rotary drill bit 110 is constructed and arranged to use at least two of the radially domed PCD inserts 120 which are angularly seated in sockets in the head mass 114 so that the axis of each insert is pitched forwardly and outwardly at preselected rake and skew angles relative to the direction of rotation.

It should be recognized that the invention is most applicable to smaller sized roof drill bits boring holes of under 2 inches due to the higher thrust required to drill at the same rate as my non-coring HDC drill bits 10, which means that higher torque is experienced and problems with shank shear may occur in larger tools.

Figure 6:
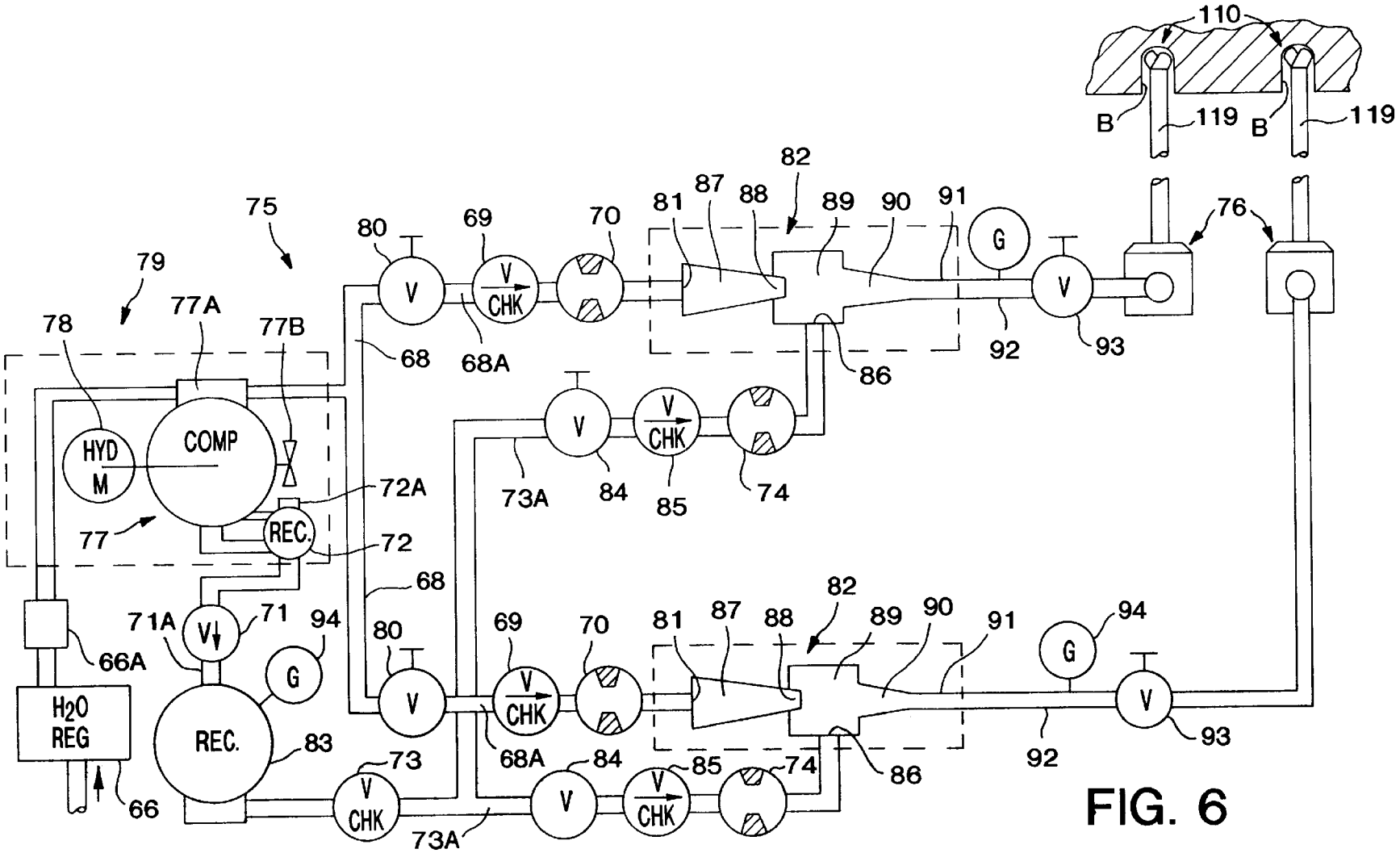
FIG. 6 is a diagrammatic view of the air-water jet drilling system of the invention.

Referring now to FIG. 6, the low volume air-water drilling system 75 of the present invention is diagrammatically illustrated as used with a double boom New Fletcher roof bolter machine having two machine drives 76 operating long rod drive steel columns 119 through adapters 112 to rotationally drive roof drill bits 110 (FIG. 2) (or the roof drill bits 10 of FIG. 1). As will be readily apparent, the drilling system 75 has a separate flushing fluid handling network for each drilling column 119, although a common air-water source may be employed for double boom machines as will now be described.

The present system 75 provides an air-water mist as the flushing fluid for use in roof drilling and other mining operations where the fluid is non-recoverable. A principal feature is the use of a water cooled compressor-pump 77 driven by a hydraulic motor 78 in a closed air cooled housing 79 to assure a cold prime mover that will operate safely in coal mines or the like for methane suppression in such environments. The air compressor 77 has a water cooled head 77A receiving a flow of water at about 100–120 psi through inlet line 67 from a water source intake regulator 66 and filter 66A, and this flow of water coolant to the compressor 77 preferably constitutes the water source for the air-water mist of the system 75. Although the optimum water line pressure is about 110–120 psi (static head), it may be within the range of 70–150 psi. The water flows through the compressor head 77A and outlet line 68 to an adjustable water volume regulating valve 80 at the selected output line pressure, i.e., about 120 psi. From the adjustable water flow valve 80, the water is delivered through line 68A and one-way check valve 69 and an orifice port or restrictor 70 to the intake port 81 of an atomizing jet pump 82. It has been determined that the use of an orifice control or restrictor 70 on the water supply side of the jet pump 82 is important to control the flow of water in the internal manifold area (89) so the water does not cut off the air intake and prevent admixing in this chamber. The volumetric flow rate of water through the flow valve 80 is in the range of 1–5 qt./min. with an optimum flow of about 3 qt./min. The orifice size selected for optimum operation is 3/32' or 7/64'.

The air compressor 77 compresses ambient air and delivers it at a volumetric rate of about 30–35 cfm at about 120 psi to a receiver or accumulator tank 83 to form a compressed air source with a capacity of about 30 gallons. A check valve 71 is provided in the receiver inlet line 71A and the compressor 77 is provided with an auto unloading valve 78 for unloading a small receiver 72A to relieve back pressure on the compressor so that it can be restarted more easily. Removing this back pressure during compressor cycling is an added safety feature and improves the life of the compressor and the hydraulic motor coupling. From the main receiver 83, the air flows through a check valve 73 in line 73A to an adjustable air volume regulating valve 84 providing a constant air output volume in the range of 12.0 to 22.0 cfm at a pressure of about 100 to 120 psi. In a single drill system (119), 120 psi pressure can be easily maintained, but in a double boom unit 76 (as shown) the pressure may fall off to about 100 psi (dynamic pressure) during constant operation. About 21 cfm at 100–120 psi has been found to be a more effective optimum air system than the previous lower pressures of 14–16 cfm tested. Compressed ambient air is then delivered at a constant flow rate through another one-way check valve 85 and an orifice restrictor 74 to air intake port 86 of the jet pump 82. The orifice or restrictor size in the air line is about 3/32'. Thus, both water and air are delivered into the large mixing chamber 89 of the jet pump 82 at about 120 psi through the respective orifice restrictors 70 and 74 thereby creating a turbulent admixture thereof.

The jet pump 82 typically operates on the principal of one fluid being entrained into a second fluid. Thus, the water flow enters the inlet port 81 through a restrictor chamber 87 to a venturi or nozzle 88 which produces a high velocity water discharge into and across the large manifold chamber 89, which also receives the air flow from inlet port 86 substantially at right angles. The high velocity water and air streams flowing into and through the chamber 89 are entrained and the flow of pressurized ambient air into the water stream causing the water particles to convert to an air-water mist, which is then pushed or carried forwardly into a diffuser section 90 and out to a discharge nozzle 91 connected to a fluid line 92 extending to the drive steel column 119 of the drilling machine 76. An operator on-off valve 93 to control system operation is provided in line 92, and pressure gauges 94 are also provided. As stated, it is clear that both the water and the air for admixing in the jet pump 82 come from the compressor 77, and that each drill column 119 receives its air-water mist fluid from a separate volume control and jet pump delivery sub-system.

It will be understood that an object of the invention is to provide a cold compressor 77 and air-water misting system to operate safely in a methane-type environment, such as a coal mine. To that end the compressor 77 has a water cooled jacket and the motor-compressor housing 77A is continuously air cooled by a fan 77B and is thus double-cooled. In addition, although not shown, the oil sump has a cooler, and the air discharge line to the receiver 83 has a coolant water jacket.

In the method of operation, coolant water from the compressor jacket is delivered to the jet pump at a pressure of 110–120 psi and is volumetrically controlled to be in the range of 1.0 to 5.0 qt./min. or at 0.016 cfm to 0.167 cfm delivery rate. In certain applications the rate of water may be as high as 0.4 cfm (2.99 gal./min.), but the typical use of the method as in coal mines will have a preferred water delivery rate of about 0.10 or 3 qt./min. delivered to the jet pump 82. Compressed ambient air from the main reservoir 83 is delivered to the jet pump 82 at a pressure of 110–120 psi at a selected rate in the range of 12 to 22 cfm, and optimally about 21 cfm, as controlled by the orifice 74. The previous air-mist delivery pressures were too high, since cuttings from the bore hole B were coming out at about 31–34 cfm deemed to be unsafe to work around. In the combined volumetric output of 12.016 to 22.4 cfm of air-water mist from the jet pump, the water content appears to be almost negligible in a ratio of about 1 to 150, and yet it has been discovered to be most efficient in the suppression of respirable dust particles generated during drilling and also highly efficient as a drill bit cooling fluid in that the water content is rapidly vaporized and dissipated by absorbing heat from the cutting elements. The system also includes the compressor by-pass or unloader 72/72A to run open if not drilling and the fan 77B provides 100% cooling whenever the compressor 77 is operating.

The method comprises double cooling the air compressor for a mining operation, producing a source of cooling water and a source of compressed air, delivering the water at a low volume and predetermined pressure to a mixing valve and also delivering a substantially higher volume of air at substantially the same pressure to the mixing valve, admixing the air and water to produce an air-water mist with small water content, and delivering the air-water mist as a low volume flushing fluid to the cutting elements in mining operations, especially in which the water is non-recoverable and respirable dust may be generated. It is apparent that any non-recoverable water usage will result in a humid ambient atmosphere even if the ground surface water is almost eliminated. The present method employs this humid ambient air as an air source for compression and mixing with the lower water volume in the jet pump 82, and the system has been found to be effective without requiring drain valves or the like in the air lines and reservoir. Thus, it will be seen that the air receiver tanks 72A and 83 have a bottom outlet feed so that they are self draining without accumulating water of compression.

It is now apparent that the objects and advantages of the present invention have been met. One feature of the invention is to deliver not only a low volume of air-water mist to the cutting elements, but to deliver this mist as continuous jets or streams and to prevent feathering in which the streams are broken up and lose their scouring action efficiency. To this end, the adapter 112 is important in establishing open passageways through channels 55.

Changes and modifications of the disclosed forms of the invention will become apparent to those skilled in the mining tool art, and the invention is only limited by the scope of the appended claims.

What is claimed is:

1. A low volume air-water flushing system for cooling and cleaning cutter elements during mining operations, comprising:

an air compressor having multiple means for cooling said compressor, water circulating means constructed and arranged for forming one of said compressor cooling means, water flow regulating means receiving water flow from said water circulating means downstream of said air compressor and comprising water volume control means for producing a low output water flow rate therefrom in the range of about 0.016 to 0.4 cfm, air flow regulating means receiving compressed air from said air compressor and comprising volume control means for producing an output air flow rate therefrom at about 12.0 to 22.0 cfm, means for receiving the output water flow and output air flow from the respective regulating means and for admixing the water and air to form an air-water mist for use as the flushing fluid, and means for delivering the air-water mist flushing fluid to mining cutter elements at a substantially constant preselected volumetric flow rate in the range of about 12.016 to 22.4 cfm/min. for optimum cooling and cleaning action during mining operations.

2. The flushing system of claim 1, in which said air compressor is of preselected size and design, and including an accumulator tank of preselected volumetric capacity interposed between said air compressor and said air flow regulating means.

3. The flushing system of claim 1, in which said air compressor cooling means include external air cooled means, discharge air cooling means and oil sump cooling means.

4. The flushing system of claim 1, in which said air compressor means is constructed and arranged to operate at about 2500 RPM and generate air flow in the range of 30–35 cfm at 100–120 psi.

5. The flushing system of claim 1, including one way check valve means in the air flow connection between the air flow regulating means and the means for admixing.

6. The flushing system of claim 1, in which said atomizing and admixing means comprises mixer valve means having separate air and water intake ports and a central mixing chamber in which the water is misted into the air, and having an outlet port through which an air-water mist jet is discharged at a flow rate pressure of about 100–120 psi.

7. The flushing system of claim 6, in which the drill bit is constructed and arranged to cut bores of a relatively small diameter below about 2 inches.

8. The flushing system of claim 1, in which the rotary drill bit is constructed and arranged with a fluted shank for attachment to a drill column having internal jet passage means, comprising bit adapter means constructed and arranged for removably attaching the drill bit to the drill column, said bit adapter means having a first end for attachment to the column and a second end defining a socket for receiving the shank of the drill bit and a through interior channel for accommodating unrestricted flow of the air mist flushing fluid therebetween, the second socket end of the bit adapter means having channel means constructed and arranged opposite to the shank flutes of the drill bit to accommodate unrestricted delivery of the fluid.

9. A method of low flow air-water flushing of a cutter element in mining operations in which the flushing fluid is non-recoverable, comprising the steps of compressing ambient air in an air compressor and delivering compressed air to a mixing valve at a flow rate in the range of 12.0 to 22.0 cfm, air cooling the air compressor, delivering water for the further cooling of the air compressor and thence to the mixing valve at a flow rate in the range of 0.016 to 0.4 cfm, admixing the air and water in the valve to form an air-water mist jet, and delivering the air-water mist jet to the cutting element at a substantially constant flow rate pressure.

10. A low volume water flushing system for cooling and cleaning cutter elements during mining operations, comprising:

an air compressor having multiple means for cooling said compressor, water circulating means constructed and arranged for forming one of said compressor cooling means, water flow regulating means for receiving water flow from said water circulating means downstream of said air compressor and producing a low output water flow rate therefrom in the range of about 0.016 to 0.4 cfm, air flow regulating means for receiving compressed air from said air compressor and producing an output air flow rate therefrom at about 12.0 to 22.0 cfm, means for receiving the output water flow and output air flow from the respective regulating means and for admixing the water and air to form an air-water mist for use as the flushing fluid, and means for delivering the air-water mist flushing fluid to mining cutter elements at a substantially constant preselected volumetric flow rate in the range of about 12.016 to 22.4 cfm/min. for optimum cooling and cleaning action during mining operations.

11. The flushing system of claim 10, in which said air compressor means is constructed and arranged to generate air flow in the range of 30–35 cfm at 100–120 psi, and air accumulator reservoir means of preselected volumetric capacity interposed between said compressor and said air flow regulating means.

12. The flushing system of claim 11, including one way air flow valve means in the air flow connection between the air compressor and the air accumulator reservoir means for isolating the latter during compressor off-cycling.

13. The flushing system of claim 12, including second air receiver means disposed between the air compressor and the one-way air flow valve, and unloader valve means associated with said second air receiver means and being constructed and arranged for depressurizing said second air receiver means during compressor off-cycling.

14. The flushing system of claim 13, in which said air compressor is constructed and arranged to compress ambient air, and said air accumulator and reservoir means are constructed and arranged to be self-draining.

15. The flushing system of claim 10, in which said air flow regulating means comprises a variable volume control valve for producing a substantially constant air flow output of about 12.0 to 22.0 cfm/min at a line pressure of about 100–120 psi.

16. The flushing system of claim 10, in which said air flow regulating means comprises air flow restrictor means of preselected orifice size for producing a substantially constant air flow output of about 21.0 cfm/min at a line pressure of about 100–120 psi.

17. The flushing system of claim 10, in which said water circulating means includes water pressure regulating means for producing a downstream water flow pressure throughout the system within the broad range of 70–150 psi.

18. The flushing system of claim 17, in which said water pressure regulating means has an optimum system setting of about 100–120 psi.

19. The flushing system of claim 10, in which said water flow regulating means is constructed and arranged to produce a low output water flow volume in the broad range of about 1–5 qt./min.

20. The flushing system of claim 19, in which the optimum water flow volume from the water regulating means is about 3 qt./min.

21. The flushing system of claim 10, in which said water flow regulating means comprises a variable volume control valve for producing a preselected water flow output.

22. The flushing system of claim 10, in which said water flow regulating means comprises water flow restrictor means of preselected orifice size for producing a preselected constant water flow output.

23. The flushing system of claim 10, in which said atomizing and admixing means comprises mixer valve means having separate air and water intake ports and a central mixing chamber in which the water flow and air flow from the regulating means are received at substantially the same line pressure of about 110–120 psi.

24. The method of claim 9, including delivering both compressed ambient air and water to the mixing valve at substantially the same line pressure of about 100–120 psi.

25. The method of claim 9, including storing compressed ambient air from the air compressor in an accumulator means, and bottom feeding compressed air from the accumulator means to obviate the build up of water of compression in the accumulator means.

26. The method of claim 9, including delivering the compressed ambient air from the air compressor through air flow control means constructed and arranged to provide a preselected constant air flow rate at an established line pressure.

27. The method of claim 9, including delivering water from the compressor cooling step through water control means constructed and arranged to provide a preselected constant waterflow rate at an established line pressure.

* * * * *